United States Patent [19]

Dronet

[11] Patent Number: 4,565,304

[45] Date of Patent: Jan. 21, 1986

[54] DOSING APPARATUS FOR VISCOUS LIQUID FOODSTUFF

[75] Inventor: Jean-Marc Dronet, Falaise, France

[73] Assignee: Plastimecanique, S.A., Falaise, France

[21] Appl. No.: 485,642

[22] Filed: Apr. 18, 1983

[30] Foreign Application Priority Data

Apr. 16, 1982 [DE] Fed. Rep. of Germany ..... 3213996

[51] Int. Cl.[4] ..... B67D 1/16; B67D 5/40; G01F 11/28

[52] U.S. Cl. ..... 222/108; 222/333; 222/379; 222/380; 222/440; 222/450; 141/67; 141/117

[58] Field of Search ..... 222/309, 379, 381, 383, 222/438, 439, 440, 450, 372, 380, 320, 108, 333; 417/469; 141/67, 25, 117; 251/5

[56] References Cited

U.S. PATENT DOCUMENTS

| | | | |
|---|---|---|---|
| 1,149,442 | 8/1915 | Hewson | 222/439 |
| 3,295,722 | 1/1967 | Gordon et al. | 222/379 |
| 3,414,312 | 12/1968 | Garlinghouse | 222/504 |
| 3,749,521 | 7/1973 | Coone | 417/900 |
| 3,895,748 | 7/1975 | Klingenberg | 222/571 |
| 4,303,100 | 12/1981 | Kalb | 251/5 |

FOREIGN PATENT DOCUMENTS 2134207 1/1973 Fed. Rep. of Germany .

*Primary Examiner*—Joseph J. Rolla
*Assistant Examiner*—Andrew Jones

[57] ABSTRACT

A liquid-dosing apparatus has a lower tube centered on an axis and having a lower end provided with a nozzle, an upper tube telescoping coaxially with the lower tube and defining therewith an axial passage extending upward from the nozzle, A supply for feeding the liquid to the passage in the upper tube, and a drive that vertically reciprocates one of the tubes axially relative to the other. Respective upper and lower annular bladders in the tubes can be pressurized to block the passage in the respective tube therewith and depressurized to unblock the passage in the respective tube. A controller connected to the drive and pressurizing system alternately pressurizes and depressurizes the bladders synchronously with vertical reciprocation of the one tube. These bladders are annular, hollow, and have inner peripheries that lie flush in the passage when the bladders are depressurized. In addition to the nozzle, tubes, and bladders are all of the same flow section and shape, whereby the passage is axially uniform.

3 Claims, 3 Drawing Figures

DOSING APPARATUS FOR VISCOUS LIQUID FOODSTUFF

FIELD OF THE INVENTION

The present invention relates to an apparatus for automatically dosing a liquid. More particularly this invention concerns such an apparatus used to fill exact amounts of a liquid and normally pasty or viscous foodstuff into respective receptacles.

BACKGROUND OF THE INVENTION

In the preparation of many different foods—from dairy snacks to candies—it is necessary to be able to accurately measure out a quantity of a viscous or pasty foodstuff and charge it into a respective receptacle. This dosing operation must be carried out rapidly and automatically, with no variation in amount from dose to dose, and with no dripping or dribbling between doses.

Accordingly German patent No. 2,134,207 describes a pump-type system having a pair of tubes telescoping along a common vertical axis. The lower tube carries at its lower end a nozzle and the upper tube is supplied at its upper end with the liquid foodstuff to be dosed. Complex valve arrangements in the passage defined by the two tubes permit flow therein only downward from the nozzle and from the upper tube along the passage into the lower tube. Thus as the two tubes are pulled apart to increase the volume of the passage the nozzle check valve closes and the upper-tube check valve opens so the passage fills with the foodstuff, and when the tubes are pushed together to decrease the passage volume the upper-tube check valve closes and the nozzle check valve open so the passage empties through the nozzle.

This system is a fairly complex mechanism. Cleaning it is therefore quite difficult. When the device is used with a spoilable foodstuff it must be thoroughly cleaned frequently, so the operation costs for the apparatus are considerable.

OBJECTS OF THE INVENTION

It is therefore an object of the present invention to provide an improved apparatus for dosing a viscous foodstuff.

Another object is the provision of such an apparatus for dosing a viscous foodstuff which overcomes the above-given disadvantages, that is which is simple in design and easy to operate and keep clean.

SUMMARY OF THE INVENTION

These objects are attained according to the instant invention in an liquid-dosing apparatus having, as described above, a lower tube centered on an axis and having a lower end provided with a nozzle, an upper tube telescoping coaxially with the lower tube and defining therewith an axial passage extending upward from the nozzle, means for supplying the liquid to the passage in the upper tube, and drive means for vertically reciprocating one of the tubes axially relative to the other. Respective upper and lower annular bladders in the tubes can be pressurized to block the passage in the respective tube therewith and depressurized to unblock the passage in the respective tube. Control means connected to the drive and pressurizing means alternately pressurizes and depressurizes the bladders synchronously with vertical reciprocation of the one tube.

In accordance with this invention the bladders are annular, hollow, and have inner peripheries that lie flush in the passage when the bladders are depressurized. The nozzle opens axially downward and the upper tube is substantially axially stationary. In addition the nozzle, tubes, and bladders are all of the same flow section and shape, whereby the passage is axially uniform. Cleaning the system of this invention is therefore very simple, since if necessary a brush or swab can be pushed right down through it and even out the nozzle. In addition the internal structure is so very simple that there are hardly any crevices in which the foodstuff can get stuck or deposit.

The drive means according to this invention includes a linear actuator braced between the two tubes parallel to the axis. This actuator in turn has a cylinder mounted on the apparatus housing and a piston rod connected to the lower tube.

To mimimize dripping, the nozzle is provided internally with an annular bladder surrounding the passage. The control means is connected to it to depressurize it during movement apart of the two tubes to withdraw a drip back into the nozzle. Thus once the machine has deposited a charge in a receptacle and normally just as the tube starts moving down again to take in a new dose, this nozzle bladder shrinks, thereby decreasing the volume of the passage downstream of the lower control bladder so that a drip hanging from the nozzle will be actually sucked back inside it.

DESCRIPTION OF THE DRAWING

The above and other features and advantages will become more readily apparent from the following, reference being made to the accompanying drawing in which.

SPECIFIC DESCRIPTION

Figure 1:
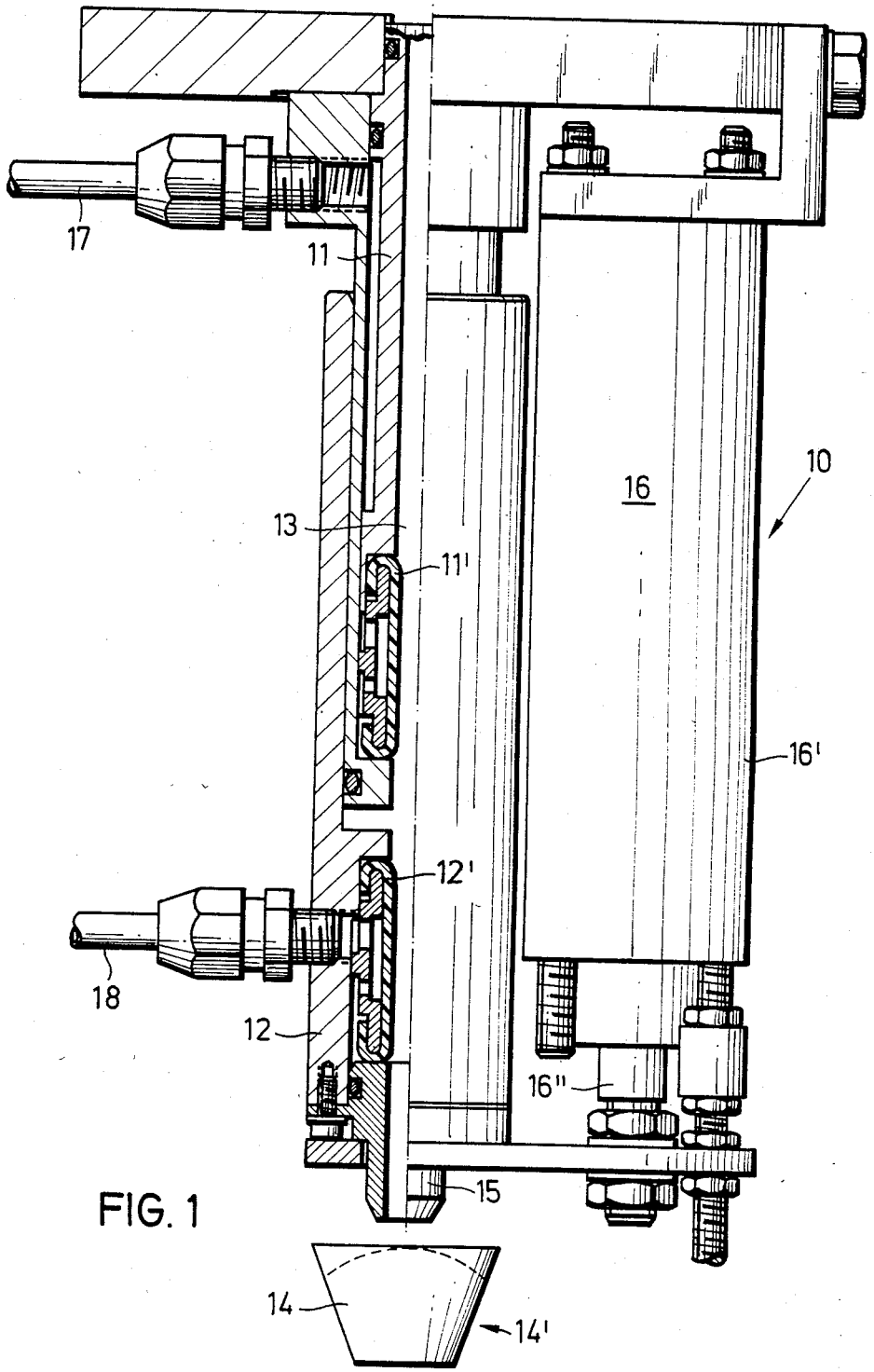
FIG. 1 is a partly diagrammatic and sectional view of the apparatus according to this invention.

As seen in FIG. 1 a dosing machine for a liquid but fairly viscous mass 14' has a stationary inner cylinder or tube 11 secured to the machine frame 20 underneath a hopper 21 or the like containing a large supply of the material 14' to be dosed into receptacles 14. This inner tube 11 is centered on an axis A and is coaxially surrounded by an outer cylinder or tube 12 that can be displaced axially relative to the inner tube 11 from the illustrated upper position to a lower position by a drive 10. This drive 10 is a simple linear actuator 16 having a cylinder 16' fixed to the housing 20, a piston rod 16'' fixed to the lower end of the cylinder or sleeve 12, and a stop arrangement 19 which limits the upward stroke in a manner well known in the art.

According to this invention the tubes 11 and 12 are provided internally with respective annular inflatable valve membranes 11' and 12', each formed as a doughnut-shaped hollow body or bladder of a durable and flexible elastomer. Respective supply lines 17 and 18 for these bladders 11' and 12' are connected via respective control valves 22 and 23 to a source 24 of a fluid, here air, under pressure. A liquid such as glycerine could also be used instead of air. A controller 25 is connected to these valves 22 and 23 as well as to the cylinder 16 to operates same synchronously in the manner described in more detail below.

Each of these annular bladders 11' and 12' assumes the solid-line position when its interior is not pressurized. In this position the inner peripheries of these elements lie flush with the cylindrical passage 13 formed by the inner walls of the tubes 11 and 12. When pressurized, however, they assume the positions shown in dot-dash lines, with their inner peripheries swollen radially inwardly so as to completely choke off the passage 13. Movement between these two positions is extremely smooth and rapid.

The lower end of the tube 12 is provided with an open nozzle 15, provided in the FIG. 1 arrangement with no internal valve structure whatsoever. This nozzle 15 is positioned above a receptacle 14 adapted to receive a dose of the mass 14'.

The arrangement described above operates as follows:

To start with the bladder/valve 12' is inflated to close off the lower end of the passage 13, the upper bladder/-valve 11' is depressurized so the passage 13 is open level with it, and the outer tube 12 is moved down by the drive 10 to suck a charge of the mass out of the supply 21. Once in the fully down position the lower bladder 12' is depressurized so it returns to the solid-line position and opens the bottom of the passage 12, and the upper bladder 11' is pressurized to block off the upper portion of this passage 13. The outer tube 12 is then raised, forcing the mass in it out past the bladder 12', through the nozzle 15, and into the vessel 14.

Once fully raised the pressurization of the two bladders 11' and 12' is again reversed and the cycle is repeated.

Figure 2:
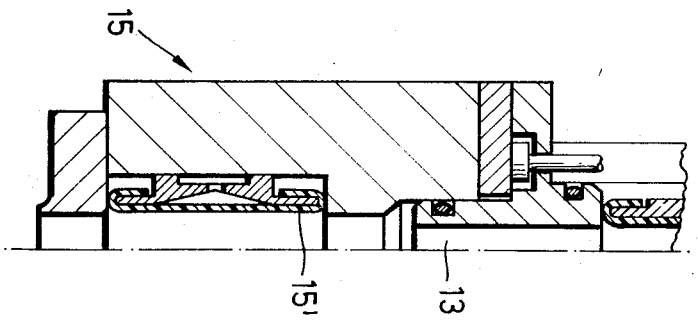
FIG. 2 is a large-scale sectional view of a detail of a variant on the apparatus of the invention.
Figure 3:
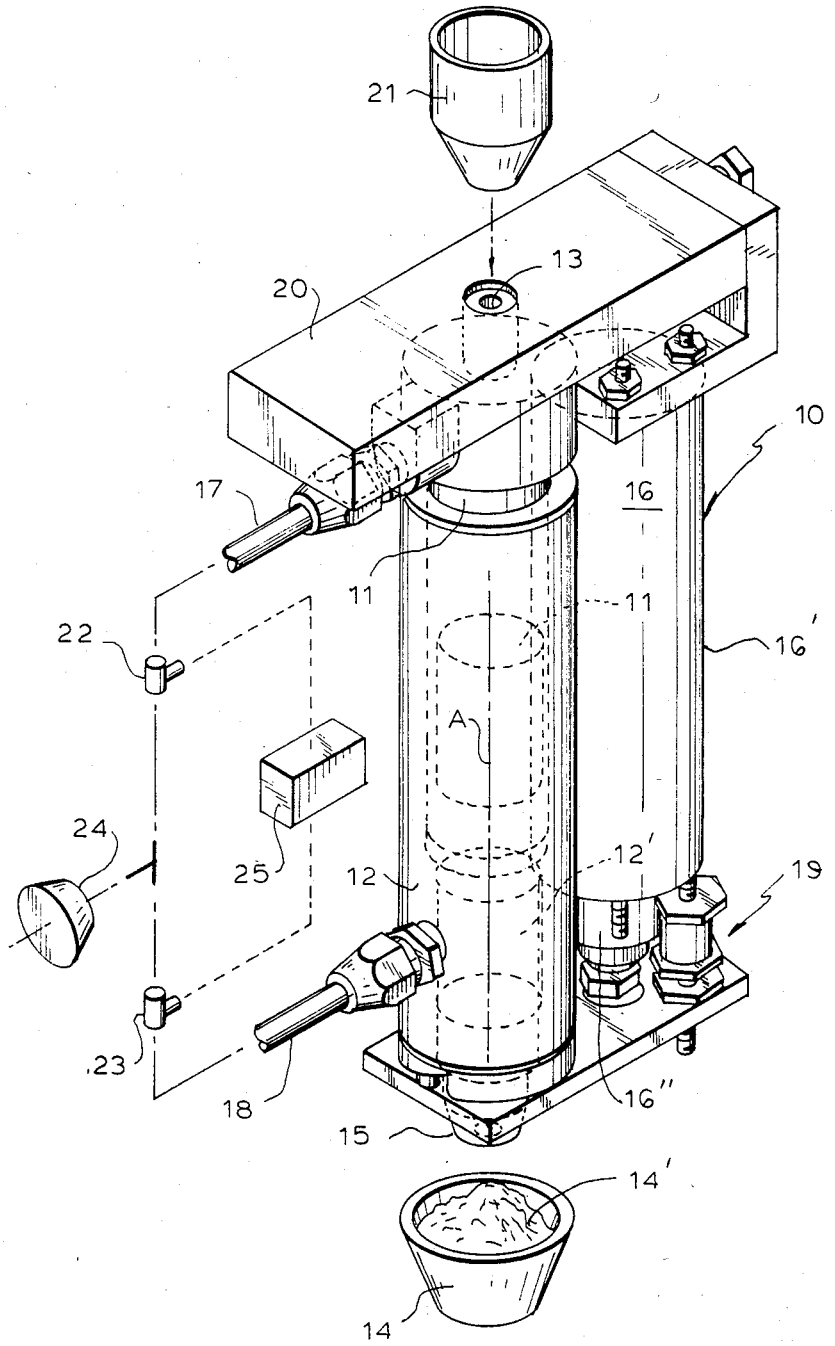
FIG. 3 is a perspective view of the apparatus according to this invention.

It is also possible to provide the nozzle 15 with a doughnut-shaped bladder 15' as shown in FIG. 2. This structure assists in preventing the nozzle 15 from dripping between dosing operations. To this end the bladder 15' is maintained inflated somewhat to take up some room in the passage 13 without, however, blocking it at all times except during the descending fill stroke of the tube 12. As soon as the rising discharge stroke of the tube 12 is complete and the lower valve/bladder 12' is again inflated and closed, the controller 25 evacuates the bladder 15' so the volume in the passage 13 below the valve/bladder 12' is decreased and the material in this lower portion of the passage 13 is partially retracted back up into it. Such action totally eliminates the possibility of dripping from the nozzle between receptacles 14.

The system according to this invention can be relatively easily cleaned. The device can, most simply, be operated with an appropriate solvent—such as hot water and a detergent—for a few cycles to largely clean it. A test-tube brush or swab can then be pushed through it to clean it more vigorously if desired, since when deflated the valve/bladders 11' and 12' leave the passage 13 wholly unobstructed.

In use the machine will accurately dose the mass. The relative axial positions of the tubes 11 and 12 when pulled apart determine how much material is held in the passage below the bladder 11', an 'the relative axial positions when they are pushed together determines how much is pumped out of the nozzle 15 when the passage is pinched closed by the bladder 11'. At no time are both bladders 11' and 12' deflated, so that the material can never just run through the machine, but instead will be metered accurately by volume.

What is claimed is:

1. An apparatus for dosing a liquid or pasty food substance comprising:

an upper tube telescoping coaxially within a lower tub, one of said tubes being coaxially movable with respect to the other of said tubes;

the upper tube being connected to a hopper and the lower tube being provided with a nozzle;

a first valve situated on the upper tube at the end facing the hopper, and a second valve situated on the lower tube in the region of the nozzle, said valves being constructed of elastic bladders;

the elastic bladder of the first valve being inserted and fixed onto the wall of the upper tube and the bladder of the second valve being inserted and fixed onto the wall of the lower tube;

said bladders being inflatable by means of a controller such that each bladder may be inflated independently and in synchronism with the axial motion of one of said tubes with respect to the other, such that conveyance of the liquid or pasty food substance is blocked when a bladder is pressurized and such that the flow of food substance is uninhibited when the bladders are depressurized;

said bladders being annular, hollow and having inner peripheries that lie flush in the inner walls of the tubes when the bladders are depressurized; and drive means for vertically reciprocating one of the tubes axially relative to the other, and an annular nozzle bladder in the nozzle surrounding the passage, the control means being connected thereto to deflate same during movement apart of the two tubes to withdraw a drip back into the nozzle.

2. The dosing apparatus defined in claim 1 wherein the nozzle, tubes, and bladders are all of the same flow section and shape, whereby the passage is axially uniform.

3. The dosing apparatus as defined in claim 1, wherein the nozzle opens axially downward and the upper tube is substantially axially stationary; the drive means includes a linear actuator between the two tubes parallel to the axis; and a housing carries the upper tube, the actuator having a cylinder mounted on the housing and a piston rod connected to the lower tube.

* * * * *